US005554493A

United States Patent [19]

Perry et al.

[11] Patent Number: 5,554,493

[45] Date of Patent: Sep. 10, 1996

[54] USE OF 2,1-BENZISOXAZOL-3(1H)-ONES AS ANTIOXIDANTS IN COLOR PHOTOGRAPHIC PROCESSING METHODS

[75] Inventors: Robert J. Perry, Pittsford; Carl A. Marrese, Penfield; Sucheta Tandon, Fairport, all of N.Y.

[73] Assignee: Eastman Kodak Company, Rochester, N.Y.

[21] Appl. No.: 553,934

[22] Filed: Nov. 6, 1995

Related U.S. Application Data

[63] Continuation-in-part of Ser. No. 404,789, Mar. 15, 1995, abandoned.

[51] Int. Cl.[6] ..... G03C 5/305; G03C 5/30

[52] U.S. Cl. ..... 430/446; 430/467; 430/483; 430/486; 430/490

[58] Field of Search ..... 430/372, 374, 430/428, 429, 435, 436, 440, 441, 464, 468, 467, 446, 480, 483, 485, 490, 375, 486, 487, 488, 491, 492, 493

[56] References Cited

U.S. PATENT DOCUMENTS

| | | | |
|---|---|---|---|
| 2,846,307 | 8/1958 | Woolley | 96/55 |
| 4,139,379 | 2/1979 | Chasman et al. | 96/3 |
| 4,192,678 | 3/1980 | Chasman et al. | 430/214 |
| 4,192,679 | 3/1980 | Erickson | 430/214 |
| 4,199,354 | 4/1980 | Hinshaw et al. | 430/226 |
| 4,199,355 | 4/1980 | Hinshaw et al. | 260/226 |
| 4,278,598 | 7/1981 | Hinshaw et al. | 260/157 |
| 4,609,610 | 9/1986 | Dunlap et al. | 430/223 |

*Primary Examiner*—Lee C. Wright
*Attorney, Agent, or Firm*—J. Lanny Tucker

[57] ABSTRACT

Certain 2,1-benzisoxazol-3(1H)-ones are useful as antioxidants in photographic color developer compositions. These compounds are highly water soluble and are essentially odorless. In addition, they have extended shelf life. They are useful in processing silver halide color photographic elements having at least one incorporated dye forming coupler.

16 Claims, No Drawings

USE OF 2,1-BENZISOXAZOL-3(1H)-ONES AS ANTIOXIDANTS IN COLOR PHOTOGRAPHIC PROCESSING METHODS

CROSS REFERENCE TO RELATED APPLICATIONS

This is a continuation-in-part of application U.S. Ser. No. 08/404,789 filed Mar. 15, 1995, entitled: "Use Of 2,1-Benzisoxazol-3(1h)-Ones As Antioxidants In Photographic Color Developers And Processing Methods" by Robert J. Perry, Carl A. Marrese and Sucheta Tandon, now abandoned.

FIELD OF THE INVENTION

The present invention relates to the use of color photographic developer compositions for processing of silver halide color photographic materials. More specifically, it relates to the use of a color developer composition having certain benzisoxazolones as antioxidants that provide extended shelf life. These methods are useful in the field of photography.

BACKGROUND OF THE INVENTION

Photographic color developing compositions are used to process color photographic materials such as color photographic films and papers to provide the desired color images. Such compositions generally contain developing agents, for example 4-amino-3 -methyl-N-(β-methanesulfonamidoethyl)aniline, as reducing agents to react with suitable color forming couplers to form the desired dyes. However, such developing agents are susceptible to oxidation by dissolved oxygen. An antioxidant is conventionally included in the developer compositions to preserve the oxidation state of the color developer and thereby maintain useful color developer activity.

Many classes of compounds have been employed as color developer solution antioxidants, including hydroxylamines, hydroxamic acids, oximes, nitroxy radicals, hydrazines, hydrazides, phenols, saccharides, various simple amines, polyamines, quaternary ammonium salts, α-hydroxy ketones, alcohols, diamides and disulfonamides. To be used in practice, however, antioxidants must be soluble in aqueous media, non-toxic to living organisms, low cost and non-silver halide developers. Further, it is desirable that antioxidants react slowly with oxygen and rapidly with oxidized color developer, but not so rapidly that color development is suppressed. Yet another concern is that the antioxidant must not be able to promote bacterial growth.

All of these considerations greatly limit the number and classes of compounds that practically can be used as antioxidants or stabilizers in color developer solutions. The compounds most often used as antioxidants are hydroxylamines. They exhibit excellent characteristics by having a slow rate of aerial oxidation, being non-silver halide developers, and are relatively inexpensive to produce. There are considerable publications describing such compounds.

While there is considerable literature describing various water-soluble hydroxylamines that can be used as antioxidants, most of them have a number of disadvantages. For example, making them with the requisite solubilizing groups may be difficult or expensive. In addition, even when generally water-soluble, they may still emit an unpleasant odor that is offensive to users in the photoprocessing industry.

In addition, the conventional hydroxylamine functionality, being a strong reducing agent, will undergo reaction with oxygen and is therefore difficult to stabilize for extended periods of time outside of a ring-closed form.

Thus, there remains a need to find relatively inexpensive, odorless and effective antioxidants for color developer compositions.

Benzisoxazolones are known for a number of uses, including antimicrobial and antileukemic effects [Wierenga et al, *J. Med. Chem.*, 27, 1212 (1984)] and as hair colorants (GB 1,255,452). In addition, they have been used in photographic emulsion layers for in-camera processing needs (see for example, U.S. Pat. No. 4,139,379 of Chasman et al, U.S. Pat. No. 4,192,679 of Erickson, U.S. Pat. No. 4,199,354 of Hinshaw et al, U.S. Pat. No. 4,199,355 of Hinshaw et al, U.S. Pat. No. 4,278,598 of Hinshaw et al and U.S. Pat. No. 4,609,610 of Dunlap et al), for scavenging oxidized developer within emulsion layers (see U.S. Pat. No. 4,192,678 of Chasman et al).

Very early literature shows their use as color couplers in color developing compositions for forming yellow dyes (see U.S. Pat. No. 2,846,307 of Woolley). None of the literature, however, considers that they would be useful as antioxidants in combination with color photographic developers for processing photographic materials with incorporated color couplers.

SUMMARY OF THE INVENTION

The problems noted above with conventional antioxidants and color developer compositions are overcome with a method for processing a color photographic element comprising:

developing an imagewise exposed color photographic element containing at least one image dye forming coupler with a photographic color developer composition having a pH of from about 9 to about 13 and comprising:

a) a primary aromatic amine color developing agent, and b) a 2,1-benzisoxazol-3(1H)-one as an antioxidant, the color developer composition being free of image dye forming couplers.

Use of the color developer composition described herein provides a number of significant advantages including less odor from the antioxidant. In addition, the antioxidant used in this invention has significantly greater shelf life compared to known antioxidants. These advantages are provided by the use of certain benzisoxazolone compounds as the antioxidants. This use of such compounds was a surprise to us in view of their very different uses in the published literature.

DETAILED DESCRIPTION OF THE INVENTION

The 2,1-benzisoxazol-3(1H)-ones described herein useful as antioxidants are described below with structure I. In color developer compositions, however, having an alkaline (usually high alkaline) pH, the isoxazole rings open up and provide one or more additional solubilizing substituents for the phenyl ring. Thus, they are highly water-soluble and exhibit little or no odor. In the closed ring form, the compounds exhibit extended shelf life.

Generally, a class of the antioxidants can be represented by the structure (I):

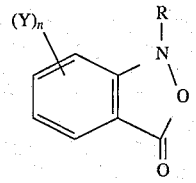

wherein Y is a solubilizing group that is generally a negatively charged group such as an acid, salt or alkyl ester thereof. Useful solubilizing groups include, but not limited to, carboxylic acid, sulfonic acid and phosphonic acid (and their corresponding salts and esters), as well as polyethylenoxy, hydroxy, sulfonamide, amido and others readily apparent to one skilled in the art. Carboxylates, sulfonates and phosphonates (as well as their corresponding acids) are preferred, and carboxylates are most preferred. Useful salts include the ammonium, alkali metal, alkaline earth and phosphonium salts of the acids. Useful alkyl esters include the methyl and ethyl esters of carboxylic, sulfonic and phosphonic acids.

Also, in the noted structure, n is 0 to 4. Preferably, it is 1 to 4, and more preferably, it is 1 or 2.

R is hydrogen, a substituted or unsubstituted linear or branched alkyl group of 1 to 10 carbon atoms (such as methyl, ethyl, n-propyl, isopropyl, t-butyl, hexyl, decyl, benzyl, methoxymethyl, hydroxyethyl, ethyleneoxy, iso-butyl and n-butyl), a substituted or unsubstituted aryl group of 6 to 14 carbon atoms (such as phenyl, naphthyl, anthryl, tolyl, xylyl, 3-methoxyphenyl, 4-chlorophenyl, 4-carbomethoxyphenyl and 4-cyanophenyl), a substituted or unsubstituted cycloalkyl group of 5 to 14 carbon atoms such as cyclopentyl, cyclohexyl, 4-methylcyclohexyl and cyclooctyl), or a 5- to 14-membered substituted or unsubstituted heterocyclic group (such as pyridyl, primidyl and furanyl).

Preferably, R is hydrogen, a substituted or unsubstituted alkyl group of 1 to 8 carbon atoms, or a substituted or unsubstituted aryl group of 6 to 10 carbon atoms. All of these groups are defined above. More preferably, R is hydrogen or an unsubstituted, linear or branched, alkyl group of 1 to 7 carbon atoms (such as methyl, ethyl, isopropyl or benzyl).

Thus, "alkyl group" is defined as meaning any unsubstituted linear or branched alkyl having the noted carbon atoms, as well as a linear or branched alkyl that is substituted with one or more of the substituents noted below up to the number of substituents that can be accommodated by the valence of the radical.

By "aryl group" is meant any carbocyclic aromatic ring system having the noted carbon atoms and one or more fused rings, which is unsubstituted or substituted with one or more of the substituents noted below.

By "cycloalkyl group" is meant an unsubstituted unsaturated carbocyclic ring system having one or more fused rings, or such a ring system that is substituted with one or more substituents as defined below. The cycloalkyl ring system can have saturated fused rings as long as one ring is unsaturated.

By "heterocyclic group" is meant an unsaturated ring system of having the noted number of any combination of carbon, nitrogen, oxygen and sulfur atoms. It can also be such as system that is substituted with one or more substituents as defined below. In addition, it can have one or more fused rings, any or all of which can be aromatic.

In defining the "substituted or unsubstituted" monovalent groups for R noted above, by "substituted" is meant the presence of one or more substituents on the group. Such substituents can be an alkyl group of 1 to 4 carbon atoms (linear or branched), hydroxy, sulfo, carbonamido, sulfonamide, sulfamoyl, carboalkoxy of 2 to 4 carbon atoms, cyano, sulfonato, thioalkyl, alkylcarbonamide, alkylcarbamoyl, alkylsulfonamide, alkylsulfamoyl, carboxyl (or salts or esters thereof), amino, (halo (such as chloro or bromo), sulfono (—$SO_2R'$) or sulfoxo [—S(O)R'], or one of the solubilizing groups defining Y which is not already included in this list. R' is a branched or linear alkyl group of 1 to 5 carbon atoms that is also the definition for "alkyl" in any of the listed substituents.

In structure (I) above, when n is 0, R cannot be hydrogen. Rather, R must be one of the other monovalent groups described in the definition above, and that group must have at least one of the solubilizing groups described in the definition of Y as a substituent. R can have more than one substituent, but at least one of those substituents must be a solubilizing group.

Preferred compounds useful as antioxidants are those represented in structure I wherein Y is —COOR", —$SO_3R$" or —$PO_3R"_2$, and R" is hydrogen, an alkali metal ion, ammonium ion, a substituted or unsubstituted alkyl group of 1 to 16 carbon atoms, a substituted or unsubstituted aryl group of 6 to 14 carbon atoms, a substituted or unsubstituted cycloalkyl group of 5 to 14 carbon atoms, or a substituted or unsubstituted 5- to 14-membered heterocylic group, all of which groups are defined above for R. More preferably, R" is an alkali metal ion, ammonium ion, or alkyl of 1 to 4 carbon atoms, and most preferably, it is methyl, ethyl or isopropyl.

More preferably, R' is hydrogen, methyl, ethyl or isopropyl.

The compounds of structure (I) can open up to form compounds of the structure (II):

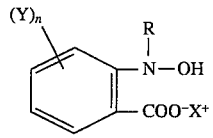

wherein Y, R and n are as defined above, and $X^+$ is a suitable cation, including but not limited to, an alkali metal ion (such as a lithium, sodium or potassium ion), a quaternary ammonium ion or a phosphonium ion. Preferably, the cation is an alkali metal ion.

Representative 2,1-benzisoxazol-3(1H)-ones useful in the practice of this invention are represented by the following structures (III-XVI):

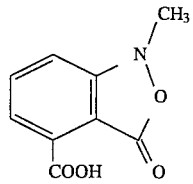

III

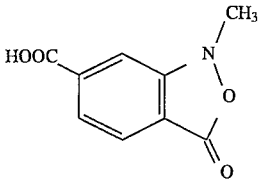

IV

-continued

V

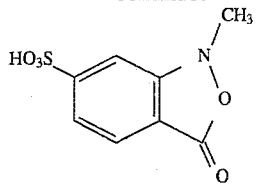

VI

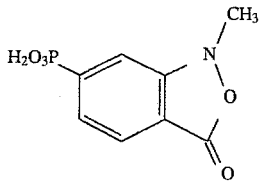

VII

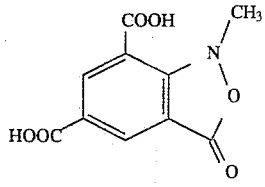

VIII

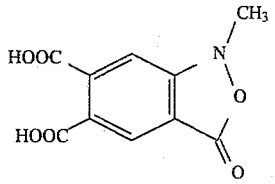

IX

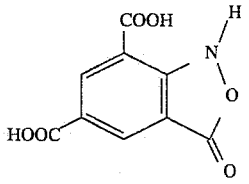

X

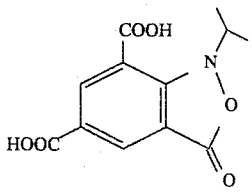

XI

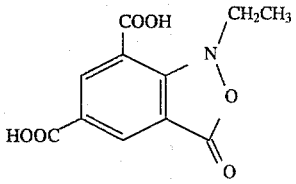

XII

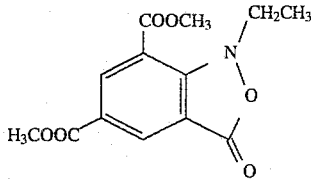

-continued

XIII

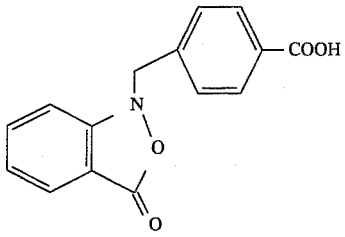

XIV

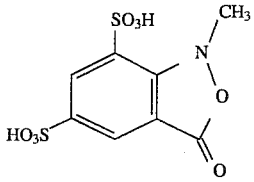

XV

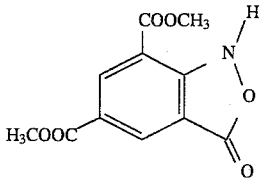

XVI

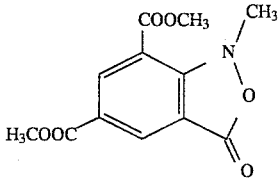

Compounds identified by structures VII and X is most preferred as antioxidants in photographic color developer compositions used in this invention.

The compounds described herein as useful antioxidants can be readily prepared using published procedures. In general, the synthetic procedures for these compounds comprise esterifying the starting benzisoxazolone with acidic methanol, followed by N-alkylating the resulting ester with a strong alkylating agent. The resulting ester groups are then hydrolyzed with base, and acidified with acid to give the desired compounds.

Specific preparations are described below prior to the Examples for illustrative purposes. The compounds for which a synthesis is not described can be similarly prepared using routine modifications that would be readily apparent to one skilled in the art.

The antioxidant is included in the color developer composition in an amount of at least about 0.001 mol/l, and a preferred amount is from about 0.01 to about 0.1 mol/l. More than one antioxidant can be used in the same color developer composition if desired. Preferably, only one antioxidant is used in a given color developer composition.

The pH of the color developer composition is generally from about 9 to about 13 (preferably from about 9 to about 11), as provided by the addition of one or more weak or strong bases (such as a hydroxide) or buffers in amounts readily known in the art. Particularly useful buffers include, but are not limited to, carbonates, borates, tetraborates, phosphates, glycine salts, leucine salts, valine salts, proline salts, alanine salts, aminobutyric acid salts, lysine salts, guanine salts and hydroxybenzoates.

The color developer compositions include one or more color developing agents, of which there are hundreds of possibilities. Useful classes of such materials include, but are not limited to, aminophenols, p-phenylenediamines (especially N,N-dialkyl-p-phenylenediamines) and others that are well known in the art, such as EP 0 434 097A1 (published Jun. 26, 1991) and EP 0 530 921A1 (published Mar. 10, 1993). Further details of such materials are provided in *Research Disclosure*, publication 36544, pages 501–541 (September 1994). *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). This reference will be referred to hereinafter as "*Research Disclosure*".

The color developer composition can be easily prepared by mixing a suitable color developer (in a suitable solution) with an antioxidant as described above (in a suitable aqueous solution). Water can be added to the resulting solution to provide the desired concentrations, and the pH can be adjusted as noted above.

The composition can also include one or more of a variety of other addenda which are commonly used in such compositions, such as alkali metal halides (such as potassium chloride, potassium bromide, sodium bromide and sodium iodide), metal sequestering agents (such as aminopolycarboxylic acids or polyphosphonates), buffers (as noted above), preservatives (such as sulfites), anti-foggants, development accelerators, optical brighteners, wetting agents, stain reducing agents, and surfactants, defoaming agents, as would be readily understood by one skilled in the art (see for example, *Research Disclosure,* noted above and U.S. Pat. No. 4,814,260 of Koboshi et al). The amounts of such additives are well known in the art also.

The color developer compositions do not contain any color couplers.

The color developing solution has obvious utility to provide color development in an imagewise exposed color photographic element comprising a support and one or more silver halide emulsion layers containing an imagewise distribution of developable silver halide emulsion grains. A wide variety of types of photographic elements (both color films and papers) containing various types of emulsions can be processed using the present invention, the types of elements being well known in the art (see *Research Disclosure,* noted above). In particular, the invention can be used to process color photographic papers of all types of emulsions, including so-called "high chloride" and "low chloride" type emulsions, and so-called "T-grain" emulsions as well. The color developer solution can also be used in color reversal processing.

Development is carried out by contacting the element under suitable time and temperature conditions, in suitable processing equipment, to produce the desired developed image. Additional processing steps can then be carried out using conventional procedures, including but not limited to, one or more development stopping, bleaching, fixing (or bleach/fixing), washing (or rinsing), stabilizing and drying steps, in any particular desired order. Useful processing steps, conditions and materials useful therefor are well known (see for example, *Research Disclosure*).

The photographic elements processed in the practice of this invention can be single or multilayer color elements. Multilayer color elements typically contain dye image-forming units sensitive to each of the three primary regions of the visible spectrum. Each unit can be comprised of a single emulsion layer or multiple emulsion layers sensitive to a given region of the spectrum. The layers of the element can be arranged in any of the various orders known in the art. In an alternative format, the emulsions sensitive to each of the three primary regions of the spectrum can be disposed as a single segmented layer. The elements can also contain other conventional layers such as filter layers, interlayers, subbing layers, overcoats and other layers readily apparent to one skilled in the art. A magnetic backing can be used as well as conventional supports.

Each dye image-forming unit of the elements contains one or more image dye forming couplers. Useful incorporated image dye forming couplers are well known, as described for example, in *Research Disclosure,* noted above, Section X(B), and references noted therein.

More particularly, the silver halide color photographic elements processed according to this invention include one or more 2- or 4-equivalent colorless or colored couplers of the open-chain ketomethylene, pyrazolone, pyrazolotriazole, pyrazolobenzimidazole, phenol or naphthol type, typically ballasted so they are non-diffusible. Polymeric image dye forming couplers can also be used. Generally, the photographic element contains at least one of each of cyan dye forming couplers, magenta dye forming couplers and yellow dye forming couplers.

More details of the element structure and components, and suitable methods of processing various types of elements are described in *Research Disclosure,* noted above. All types of emulsions can be used in the elements, including but not limited to, thin tabular grain emulsions, and either positive-working or negative-working emulsions. The elements can be either photographic film or paper elements, but preferably, they are photographic papers.

The elements are typically exposed to suitable radiation to form a latent image and then processed to form a visible dye image. Processing includes the step of color development in the presence of a color developing agent to reduce developable silver halide and to oxidize the color developing agent. Oxidized color developing agent in turn reacts with an incorporated image dye forming coupler to yield a dye.

Development is then followed by the use of a suitable bleaching solution in a bleaching step carried out in any suitable fashion, as is known in the art. Color prints and films can be processed using a wide variety of processing protocols, as described for example, in *Research Disclosure,* noted above, and thus can include various combinations of one or more bleaching, fixing, washing or stabilizing steps in various orders, and lastly, drying. Additionally, reversal processes include additional steps of black and white development, chemical fogging, re-exposure, and washing prior to color development.

Processing according to the present invention can be carried out using conventional deep tanks holding processing solutions. Alternatively, it can be carried out using what is known in the art as "low volume thin tank" processing systems, or LVTT. Such processing methods and equipment are described, for example, in U.S. Pat. No. 5,436,118 (Carli et al) and publications noted therein.

The following examples are provided to illustrate the practice of this invention and not to limit it in any way. Unless otherwise indicated, percentages are by weight.

Preparation of Antioxidants:

Compound IX was prepared using the procedures described by Kim et al, *J. Heterocyclic Chem.,* 22, 127 (1985) or in U.S. Pat. No. 4,199,354 (noted above).

Compound XV was prepared by bubbling anhydrous hydrochloride acid into a slurry of Compound IX (45 g, 202 mmole) and anhydrous methanol (125 ml) for 5 minutes. The resulting deep red solution was stirred at reflux for 17 hours and cooled, and the resulting solid was filtered and washed with methanol to give 34 g (67% yield) of product. m.p. 165°–166° C., $^1$H NMR (DMSO-$d_6$) δ8.42(s,1), 8.27(s, 1), 3.86(s,3), 3.82(s,3).

Compound XVI was prepared by adding dimethylsulfate (7.04 ml) to a solution (150 ml) of compound XV (17 g, 67.7 mmole) and potassium carbonate (4.68 g, 33.8 mmole) in N,N-dimethylformamide over 30 seconds. After 30 minutes, the reaction mixture was filtered and precipitated into sodium bicarbonate (0.5%, 1 liter). The resulting solid was filtered and washed with water, then recrystallized from 80% methanol/water, washed with methanol and dried to give 11.9 g (66% yield) of product. m.p. 150-5-152° C. $^1$H NMR (DMSO-$d_6$) δ8.65(s,1), 8.39(s,1), 3.90(s,3), 3.87(s,3), 3.53(s,3). $^{13}$C{$^1$H} NMR (DMSO-$d_6$) δ165.4, 164.2, 163.0, 157.7, 137.7, 131.2, 125.6, 115.8, 115.1, 53.0, 52.8, 43.0.

Compound VIII was prepared by treating a solution of Compound XVI (13.26 g, 50 mmole) in methanol/tetrahydrofuran (130 ml/80 ml) with aqueous sodium hydroxide (6 g, 150 mmole, 60 ml) for 30 minutes at 50° C. The reaction mixture was acidified with concentrated sulfuric acid to pH 4, then diluted with water and twice extracted with ethyl acetate (350 ml each). The extracts were combined, dried over magnesium sulfate and concentrated to give the desired product (2.8 g, 24% yield). $^1$H NMR (DMSO-$d_6$) δ8.68(d, J=b 1.7Hz,1), 8.33(d,J=1.7 Hz,1), 3.54(s.3).

Compound XII was prepared by adding diethylsulfate (9.5 ml) to a solution (125 ml) of Compound XV (16.6 g, 66,1 mmole) and potassium carbonate (4.57 g, 33 mmole) in dimethylformamide over 30 seconds. After 1.5 hour of reaction, the mixture was filtered and precipitated into 0.5% sodium bicarbonate (1.5 liter). The resulting solid was filtered and washed with water, then recrystallized from 60% ethanol/water, washed with 60% ethanol/water and dried to give 15.2 g (86% yield) of product. m.p. 84°–85° C. $^1$H NMR(DMSO-$d_6$) δ8.62(d,J=b 1.5Hz,1), 8.36(d,J=1.5 Hz,1) 3.90(s,3), 3.88(q,J=7.0,2) 3.86(s,3), 1.13(t,J=7.0 Hz,3).

Compound XI was prepared by treating a solution of Compound XII (2 g, 7.5 mmole) in methanol/tetrahydrofuran (25 ml/10 ml) with aqueous sodium hydroxide (0.9 g, 22.5 mmole, 10 ml) for 30 minutes at ambient temperature. The reaction mixture was acidified with concentrated hydrochloride acid to pH 4, then diluted with water and extracted twice with trichloromethane (75 ml each). The extracts were combined, dried over magnesium sulfate and concentrated to give 1.3 g (65% yield) of product. $^1$H NMR(DMSO-$d_6$) δ13.55(bs s,2), 8.69(d,J=1.2 Hz,1), 8.35(d,J=1.2 Hz,1), 3.96(q,J=6.8 Hz,2), 1.09(t,J=6.8 Hz, 3). Calculated analysis for $C_8H_{20}N_2O_2$: C, 54.52, H, 11.44, N, 15.89. Found: C, 54.28, H, 10.92, N, 15.89.

EXAMPLE 1

Color Developer Solution

This example demonstrates the preparation of a useful photographic color developer composition. The components of the composition as shown in Table I below, were mixed together.

TABLE I

| Component | Concentration/ liter |
|---|---|
| Lithium salt of sulfonated polystyrene (30% w/w) | 0.25 ml |
| Triethanolamine | 11 ml |
| KODAK EKTAPRINT ™ 2 Stain Reducing Agent | 2.3 g |
| Compound VIII | 11.86 g |
| Lithium sulfate | 2.7 g |
| 1-Hydroxyethylidene-1-diphosphonic acid (60% w/w) | 0.8 ml |
| Potassium chloride | 1.8 g |
| Potassium bromide | 0.2 g |
| 4-Amino-3-methyl-N-ethyl-N-(β-methanesulfonamidoethyl)aniline | 4.85 g |
| Potassium carbonate | 25 g |
| Water to 1 liter solution | |

pH adjusted to 10.12 with sodium hydroxide

The prepared color developer composition was subjected to aeration by bubbling air through 1 liter of the composition of Example 1 at a rate of 0.5 standard ft$^3$/hr (0.014 m$^3$/hr). The concentration of color developer was measured by high performance liquid chromatography as a function of time.

EXAMPLE 2

Processing of Photographic Element

The color developer composition of Example 1 was used to process a conventional photographic element. In addition, a similar color developer composition containing antioxidant compound VII was also prepared and used to process the same type of elements.

For comparison purposes, a second developer composition (Control A) containing the same formulation as noted above was prepared except that it contained N,N-diethylhydroxylamine (a common antioxidant, DEHA) instead of the 2,1-benzisoxazol-3(1H)-one antioxidants, at the same concentration.

All three color developer compositions were used to process samples of KODAK EKTACOLOR™ Color Paper that had been imagewise exposed by a step tablet varying exposure by 0.1(logE) over 20 steps using conventional procedures. Densitometry data that were obtained using conventional procedures are presented in Table II below. The "differences" shown in the Table were obtained by comparing the present invention to the use of DEHA.

TABLE II

| | DEHA | VII | Difference | VIII | Difference |
|---|---|---|---|---|---|
| Red Dmin | 0.120 | 0.103 | −0.017 | 0.118 | −0.002 |
| Green Dmin | 0.095 | 0.071 | −0.024 | 0.095 | −0.000 |
| Blue Dmin | 0.090 | 0.071 | −0.019 | 0.085 | −0.005 |
| Red Toe | 0.362 | 0.347 | −0.015 | 0.348 | −0.014 |
| Green Toe | 0.379 | 0.346 | −0.033 | 0.360 | −0.019 |
| Blue Toe | 0.405 | 0.377 | −0.028 | 0.388 | −0.017 |
| Red Shoulder | 2.049 | 2.090 | 0.041 | 2.120 | 0.071 |
| Green Shoulder | 1.925 | 2.091 | 0.166 | 2.092 | 0.167 |
| Blue Shoulder | 1.751 | 1.833 | 0.082 | 1.841 | 0.090 |
| Red Dmax | 2.617 | 2.555 | −0.062 | 2.593 | −0.024 |
| Green Dmax | 2.506 | 2.501 | −0.005 | 2.572 | 0.067 |
| Blue Dmax | 2.331 | 2.422 | 0.091 | 2.473 | 0.142 |
| Red Speed | 174 | 175 | 1.5 | 174 | 0.5 |
| Green Speed | 153 | 152 | −1.0 | 155 | 1.5 |
| Blue Speed | 169 | 160 | −8.5 | 170 | 1.5 |

The data indicate that the present invention provides acceptable developing compared to the conventional developer composition. However, the However, the present invention avoids the severe odor problem with the conventional antioxidant.

In addition, we found that the antioxidants used in the present invention have improved long term shelf life over known antioxidants. Moreover, we found that the use of Compound VII as the antioxidant maintained color developer pH better than the use of fructose, which is a known color developer antioxidant.

The invention has been described in detail with particular reference to preferred embodiments thereof, but it will be understood that variations and modifications can be effected within the spirit and scope of the invention.

We claim:

1. A method for processing a color photographic element comprising:

developing an imagewise exposed color photographic element containing at least one image dye forming coupler with a photographic color developer composition having a pH of from about 9 to about 13 and comprising:

a) a primary aromatic amine color developing agent, and b) a 2,1-benzisoxazol-3(1H)-one as an antioxidant, said color developer composition being free of image dye forming couplers.

2. The method of claim 1 wherein said antioxidant has the structure:

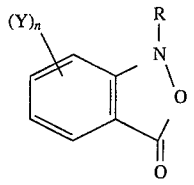

wherein

Y is a solubilizing group, n is 0 to 4, and

R is hydrogen, an alkyl group of 1 to 10 carbon atoms, an aryl group of 6 to 14 carbon atoms, cycloalkyl of 5 to 14 carbon atoms, or a 5- to 14-membered heterocyclic group, provided that when n is 0, R is not hydrogen and comprises at least one solubilizing group.

3. The method of claim 2 wherein Y is a carboxylic acid, sulfonic acid, phosphonic acid, or a salt or ester thereof, and n is 1 to 4.

4. The method of claim 3 wherein Y is —COOR", —$SO_3$R" or —$PO_3R"_2$ wherein R" is hydrogen, an alkyl group of 1 to 16 carbon atoms, aryl of 6 to 14 carbon atoms, cycloalkyl of 5 to 14 carbon atoms, a 5- to 14-membered heterocylic group, an alkali metal ion or ammonium ion.

5. The method of claim 4 wherein R" is hydrogen, methyl, ethyl, isopropyl or an alkali metal ion.

6. The method of claim 2 wherein R is hydrogen, an alkyl group of 1 to 8 carbon atoms, or an aryl group of 6 to 10 carbon atoms.

7. The method of claim 6 wherein R is hydrogen or an alkyl group of 1 to 7 carbon atoms.

8. The method of claim 7 wherein R is hydrogen, methyl, ethyl, isopropyl, or benzyl.

9. The method of claim 2 wherein n is 1 or 2.

10. The method of claim 1 further comprising at least one bleaching, fixing, washing or rinsing step after said developing step.

11. The method of claim 1 wherein said color developing composition has a pH of from about 9 to about 11.

12. The method of claim 1 wherein said antioxidant is present in said color developer composition in an amount of at least about 0.001 mol/l.

13. The method of claim 12 wherein said antioxidant is present in an amount of from about 0.01 to about 0.1 mol/l.

14. The method of claim 1 wherein said color developer composition further comprises at least one compound selected from the group consisting of a metal sequestering agent, an anti-foggant, an alkali metal halide, a buffer, a stain reducing agent, a surfactant, a development accelerator, an optical brightener, a wetting agent, defoaming agent and a water-soluble or water-dispersible color coupler.

15. The method of claim 1 wherein said antioxidant has the formula VII or X:

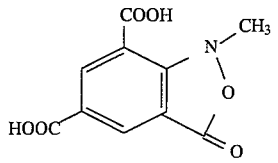

VII

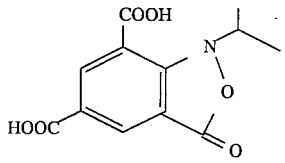

X

16. The method of claim 1 wherein said color photographic element is a multicolor photographic element comprising at least one of each of a cyan dye forming coupler, a magenta dye forming coupler and a yellow dye forming coupler.

* * * * *